United States Patent [19]

Tomaszewski et al.

[11] 4,367,985

[45] Jan. 11, 1983

[54] METHOD OF SEALING SALINA EXCAVATIONS

[75] Inventors: Jerzy Tomaszewski; Andrzej Chmarzynski; Rafal Nowakowski, all of Torun, Poland

[73] Assignee: Uniwersytet Mikolaja Kopernika, Torun, Poland

[21] Appl. No.: 88,279

[22] Filed: Oct. 25, 1979

[30] Foreign Application Priority Data

Oct. 17, 1978 [PL] Poland ..... 210332
Mar. 15, 1979 [PL] Poland ..... 214184

[51] Int. Cl.[3] ..... E02D 3/12
[52] U.S. Cl. ..... 405/264; 405/263
[58] Field of Search ..... 299/4, 5; 405/57, 263, 405/264

[56] References Cited

U.S. PATENT DOCUMENTS 3,055,423 9/1962 Parker ..... 405/263 X
3,148,000 9/1964 Dahms et al. ..... 299/5
3,366,419 1/1968 Pasternak et al. ..... 299/5
3,833,709 9/1974 Chassagne ..... 299/5 X
4,136,998 1/1979 Bassier et al. ..... 405/263 X
4,192,555 3/1980 Willett ..... 299/4

FOREIGN PATENT DOCUMENTS 190871 11/1906 Fed. Rep. of Germany .

*Primary Examiner*—James A. Leppink
*Assistant Examiner*—George A. Suchfield
*Attorney, Agent, or Firm*—Ladas & Parry

[57] ABSTRACT

Disclosed is a method of sealing salt mine headings. Salting out substances, adapted in quantity and quality for properties of effluent from the rift, are introduced into a rift in a rock mass, thus causing crystallization of salts identical or isostructural in relation to the salt forming the rock mass. The substances may be aqueous solutions of inorganic salts or they may be organic solvents. To avoid difficulty in mixing solutions, crevices are liquefied by introducing to their zone effluent and/or saline previously prepared and modified with salting out solutions. As inorganic salts, calcium chloride, magnesium chloride or mixtures thereof are used. As organic solvents, methanol or acetone is used.

8 Claims, No Drawings

METHOD OF SEALING SALINA EXCAVATIONS

This invention relates to a method of sealing salina excavations, and more particularly applies to liquidation of the effluent and the capillary rifts which are a potential cause of flooding the excavation.

Already known is a method of liquidation of the effluents and capillary rifts based upon warming of the rock mass by first introducing carnallite liquor of low concentration and at a temperature lower than 363° K. (degrees Kelvin) but higher than the rock mass temperature to the openings drilled within the zone of effluent and capillary rifts. Then, compressed, oversaturated carnallite liquor, having temperature of 363° to 423° K., is introduced to the thus warmed rock mass.

The problem with this prior art method is that sylvine crystals, which were precipitated during crystallization don't secure homogeneous sealing of the rifts, the nonhomogeneous crystallization being caused by a temperature gradient. Also known from the prior art is German Pat. No. 190,871, which also discloses a method of sealing the effluent in the rifts of rocks. The method consists of introducing a crystallizing brine, either with or without forced cooling, to the rifts having a temperature of 293° K. The problem with this prior art method is that it does not enable the crystallization process to be controlled, which leads to poor cohesion of the crystals thus obtained and consequently ineffective sealing.

The present invention avoids these problems. The technical problem solved by the present invention is the discovery of rock mass material salting out media and conditions of their use, which assure an easy and reliable way of sealing salina excavations.

The method of the present invention is based upon the introduction of salting out media which are inorganic salts or organic solvents, adjusted in quantity and quality to the effluent properties as determined by its total chemical analysis and solubility isotherm of the proper system, to the effluent, then into the rift of the rock mass, providing such supersaturation as to secure maximum linear speed of the rift walls overgrowth by crystals identical or isostructural with the salts forming the rock mass. The amount of added salting out agent, which modifies the composition of the effluent, should be such as to stimulate the crystallization process on the walls of the rift immediately. To increase the effect of crystallization, it is advantageous to form crystal nuclei of the native rock mass salts or of foreign salts in suspension, especially those of calcium sulphate, calcium carbonate or magnesium carbonate. In the following phase of the sealing process, crystal nuclei are overgrown with crystals isostructural with respect to the rock mass structure. As salting out agents, solutions of water soluble salts are used, preferably calcium chloride or magnesium chloride. They cause salting out of, for example, sodium chloride and potassium chloride which crystallize on the rims of the rift walls. In the event of the simultaneous occurrence of sulphates and carbonates in the effluent, then the respectively sparingly soluble calcium and magnesium salts crystallize. The effluent containing too little of isostructural salt with respect to the rock mass salt, should be enriched in that salt. As organic solvents, methanol and acetone are preferrably used. They cause crystallization of sulphates first, then almost paralelly sodium chloride and potassium chloride. Calcium and magnesium chlorides remain in the liquor. The salting out media or organic solvents are usually introduced under pressure into the rift at least few meters away from the outlet of the effluent, through the respectively drilled hole.

The present invention also provides a method of sealing salina excavations possessing capillary rifts, which relies upon continuously introducing under pressure the effluent and/or the brine or saline modified previously with salting out solutions to the holes drilled within the zone of rifts. Good results of sealing are achieved also by introducing the compressed effluent and/or saline alternately with the sealing out solutions. Or by introducing the effluent and/or the saline continuously, but with portioning of the salting out solutions. Introducing the effluent and/or the saline alternately with the salting out solutions results in overgrowth of the crystals on the walls of the capillary rifts. In the event where the application of the above methods doesn't allow for sealing the rock mass completely, alternately introduced is the effluent and/or the saline followed by the salting out solutions, with that the effluent and/or the saline should contain cations or anions, but the salting out solution should contain anions or cations which form suspensions of crystals identical or isostructural with the rock mass salts sealing the rifts. For this purpose the salts contained in the rock mass are used, such as calcium sulphates or orthophosphates. As a result of the reaction between the ions of these salts in the sediment, mechanically sealed capillary rifts are formed. With regard to this, the solutions used are simultaneously supersaturated towards sodium chloride, and they form a strong bond between the one crystals with each other in the sediment and with the walls of the rift. Water-soluble inorganic salts, preferably calcium chloride or magnesium chloride and alternately organic solvents such as methanol or acetone are used as the salting out solutions. Methanol or acetone cause crystallization of sulphates first and then almost simultaneously sodium chloride and potassium chloride. The effluent and/or the saline is modified preferably at a temperature higher than the rock mass temperature, and is adjusted to such a degree of supersaturation, which allows overgrowth of the crystals on the walls of the capillary rifts, but not the spontaneous forming of crystal nuclei. The inductive period should hence last up to several hours, according to the length of the rifts and the intensity of the flow as the sealing solution through them. In the last stage of supersaturation, it is recommended to prepare the effluent and/or the saline to such a degree of supersaturation which will assure forming of the crystal nuclei also in the suspension.

The virtue of the method according to the present invention is the complete elimination of the formation of gaps on the contact area between the sealing material and the rock mass. Application of the rock mass salts and also salts isostructural with them achieves a high reliability of sealing.

The method according to the invention is illustrated by the following examples, which don't exclude their wider range of application. The linear speeds of crystallization have been achieved at the constant flow rate of the modified effluent, which was $1.7\times10^{-3}$ m/s.

EXAMPLE I:

To 128 kg (kilograms) of the effluent containing 2.4 kg of sodium chloride, 1.8 kg potassium chloride, 8.9 kg magnesium sulphate, 24.4 kg magnesium chloride, 90.5 kg of water, were introduced 83 kg of methanol into the respectively drilled holes in the rock mass sample. Potassium sulphate and magnesium sulphate crystallize in the sediment and sodium chloride partially with potassium chloride crystallized on the walls of the rift and partially in the sediment. The linear speed of the rift walls overgrowth amounted to $4.5\times10^{-9}$ m/s.

EXAMPLE II:

To 123 kg of the effluent containing 14.6 kg of sodium chloride, 1.7 kg potassium chloride, 7.6 kg magnesium chloride and 9.2 kg calcium chloride, 89.9 kg of water, were introduced 15 kg of methanol into the respectively drilled holes in the rock mass sample. Sodium chloride crystallized on the wall of the rift with a linear speed of $9.3\times10^{-9}$ m/s.

EXAMPLE III:

To 123 kg of the effluent of the same composition as in Example II, 4 kg of calcium chloride solution having a concentration of 41.4% were introduced. Crystallization of sodium chloride occurred on the walls of the rift with a linear speed of $7.2\times10^{-9}$ m/s.

EXAMPLE IV:

To 127 kg of the effluent containing 1.5 kg of sodium chloride, 1.7 kg potassium chloride, 89.3 kg of water, and 34.5 kg magnesium chloride, 20 kg of calcium chloride solution having a concentration of 44% have been introduced into the respectively drilled holes in the rock mass sample. The linear speed of sodium chloride crystallization together with potassium chloride crystallization amounted to $6.7\times10^{-9}$ m/s.

EXAMPLE V:

To 128 kg of the effluent of the same composition as in Example I, 53 kg of magnesium chloride solution have been introduced. Sodium chloride crystallized together with potassium chloride with a linear speed of $9.3\times10^{-9}$ m/s.

EXAMPLE VI:

To 123 kg of the effluent of the composition as in Example III, 13.4 kg of 35% magnesium chloride solution have been introduced. Sodium chloride crystallized with the linear speed of $1.1\times10^{-8}$ m/s.

EXAMPLE VII:

To the bore-hole drilled in a zone of capillary rifts in the rock salt bed at a temperature of 293° K., sealing solution was introduced under a pressure of $1.52\times10^5$ Pa, in portions. The batches of the solution were prepared from the brine obtained by dissolving with mixing 1.23 kg of sodium chloride and 27.19 kg of magnesium chloride in 70.24 kg of water and then introducing the solution to the bore-hole with an equal amount of a 44.45% aqueous solution of calcium chloride, in order to obtain the solution saturated towards sodium chloride at a temperature of 308° K. After letting 0.3 $m^3$ of thus prepared solution flow in portions through the sealed rock mass, its flow rate decreased to 18.7% of the starting value.

EXAMPLE VIII:

To the bore-hole drilled in the rock mass as in Example VII, the sealing solution was introduced in portions under a pressure of $2\times10^5$ Pa. The batches of solutions were prepared from the saline obtained by dissolving with mixing 11.87 kg of sodium chloride, 1.34 kg potassium chloride, 6.18 kg magnesium chloride and 7.52 kg of calcium chloride in 73.09 kg of water and then introducing the solution to the bore-hole with an equal amount of 49% aqueous calcium chloride solution, to obtain the solution saturated towards sodium chloride at a temperature of 308° K. After letting 0.7 $m^3$ of the solution flow in portions through the sealed rock mass, its flow rate decreased to 6% of the starting value. In order to achieve complete sealing of the rock mass, a sealing solution containing 1.85 kg of sodium chloride, 1.44 kg of potassium chloride, 6.96 kg magnesium sulphate and 19.09 kg of magnesium chloride dissolved in 70.66 kg of water, followed by a solution containing 5% calcium chloride solution and 21.7% of sodium chloride, saturated towards sodium chloride at a temperature of 303° K., were introduced under a pressure of $2\times10^5$ Pa, alternately in portions. After two cycles of alternately introducing these solutions to the rock mass, complete sealing of the rock mass was achieved.

EXAMPLE IX:

To the bore-hole drilled in a rock mass as in Example VII, to the effluent of the composition: 11.87 kg of sodium chloride, 1.39 kg potassium chloride, 6.18 kg magnesium chloride and 7.52 kg calcium chloride dissolved in 73.14 kg of water, forced under a pressure of $3.03\times10^5$ Pa, and a 49% aqueous solution of calcium chloride were introduced in portions. After allowing the effluent and 49% solution of calcium chloride to flow with a volume rate of 50:1 and a total volume of 0.4 $m^3$, the effluent flow rate decreased to 5% of the starting value.

We claim:

1. In a method of sealing salina excavations, wherein salting out substances are introduced into the effluent from rock mass salt rifts, said salting out substances being selected from the group consisting of inorganic salts, organic solvents, and mixtures thereof, the improvement comprising the steps of: sampling said effluent; adjusting said salting out substances in quantity and quality to the effluent properties, said properties being determined with regard to the complete chemical analysis of said effluent and the solubility isotherm of said effluent in a given system, and adjusting to such a degree of supersaturation which will allow maximization of the linear speed of overgrowth of the wall of the rift by crystals identical with or isostructural with the salts forming the rock mass; and then introducing the suspension of the effluent thus adjusted with the salting out substance into the rifts to control the rate of crystallization to achieve uniform sealing of said rifts.

2. The method according to claim 1, further including accelerating the sealing process by also forming, in the suspension, crystal nuclei of the group consisting of the rock mass salts, foreign salts, and mixtures thereof.

3. The method according to claim 1, wherein the adjusted effluent modified with said salting out substances is introduced continuously under pressure, into bore-holes drilled in a zone of capillary rifts in an inorganic salt rock mass to seal said rifts.

4. The method according to claim 3 wherein the introduction is by portions.

5. The method according to claim 3, wherein the introduction of the adjusted effluent modified with said salting out substances is followed by the introduction under pressure of more salting out substances into the bore-holes.

6. The method according to claims 3, 4 or 5, wherein the process is repeated at least once so that the introduction of the adjusted effluent modified with said salting out substances alternates with the introduction of more salting out substances into the bore-holes.

7. The method according to claim 3 further including that the adjusted effluent, the salting out substances, or both contain cations or anions whereas the salting out substances are comprised of organic solvents, aqueous solutions of inorganic salts, or mixtures thereof so that anions and cations form in the suspension crystals foreign to the salt rock mass, to seal said rifts.

8. The method according to claim 1, wherein the inorganic salts are selected from the group consisting of calcium chloride, magnesium chloride, and mixtures thereof, and the organic solvents are selected from the group consisting of methanol and acetone.

* * * * *